United States Patent [19]

Furusawa et al.

[11] Patent Number: 5,073,338

[45] Date of Patent: Dec. 17, 1991

[54] HIGH STRENGTH STEEL BOLTS

[75] Inventors: Sadayoshi Furusawa; Toyofumi Hasegawa, both of Kobe; Takeshi Nakahara, Akashi; Takehiko Kato, Kobe, all of Japan

[73] Assignee: Kabushiki Kaisha Kobe Seiko Sho, Kobe, Japan

[21] Appl. No.: 590,137

[22] Filed: Sep. 28, 1990

[51] Int. Cl.[5] ..... C22C 38/28

[52] U.S. Cl. ..... 420/109; 420/110

[58] Field of Search ..... 420/109, 110; 148/334, 148/335

[56] References Cited

U.S. PATENT DOCUMENTS 3,291,655 12/1966 Gill et al. ..... 420/110

4,778,652 10/1988 Fukizawa et al. ..... 420/110

FOREIGN PATENT DOCUMENTS 4532813 10/1970 Japan ..... 148/334

*Primary Examiner*—Deborah Yee

*Attorney, Agent, or Firm*—Oblon, Spivak, McClelland, Maier & Neustadt

[57] ABSTRACT

Described herein is high strength steels used for bolts containing as alloy elements:

$0.30\% \leqq C \leqq 0.50\%$, $Si < 0.10\%$, $0.50\% \leqq Mn \leqq 0.70\%$, $P \leqq 0.01\%$, $S \leqq 0.01\%$, $0.30\% \leqq Cr \leqq 1.05\%$, $0.50\% \leqq Mo \leqq 1.05\%$, $0.01\% \leqq al \leqq 0.05\%$, $0.0020\% \leqq Ti \leqq 0.050\%$, and $0.002\% \leqq N \leqq 0.010\%$, the elements Si, Mn, P, S, Mo, Al, Ti and N satisfying the relation as follows $0.05\% \leqq Mo - 45P - 11S \leqq 0.85\%$ $7.5Si + 1.7Mn \leqq 1.85\%$, and $0.020\% \leqq 10Ti + Al - 6N \leqq 0.50\%$;

and the balance of Fe and inevitable impurities.

The high strength steels used for bolts may optionally contain at least one of Ni and V in the range of $0.2\% \leqq Ni \leqq 1.5\%$ and $0.05\% \leqq V \leqq 0.15\%$, respectively.

2 Claims, No Drawings

HIGH STRENGTH STEEL BOLTS

BACKGROUND OF THE INVENTION

1. Field of the Invention

This invention relates to a high strength steel suitable for application as high strength bolts for motor vehicles or as hexagon socket head cap screw on various industrial machines, and more particularly to a high strength bolt steel which is improved in delayed fracture strength and cold forgeability.

2. Description of the Prior Art

Low-alloy steel for machine structural use, especially, AISI 4135 and 4140 are generally used for high strength bolts. These steels have the tensile strength of 120–130 kgf/mm$^2$, and are endurable up to a considerably high stress. In a particular field of application where a higher stress in required, attempts have been made to achieve a required strength by modification of alloy elements.

However, such modified steels used for high strength bolts have the problem of the so-called delayed fracture, i.e., a sudden fracturing occures during use over a long period of time in fastenned state. In this regard, a number of laid-open patent applications disclose the results of researches and developments which have been conducted with a view to solving the just-mentioned problem. For example, Japanese Laid-Open Patent Application 60-114551 discloses steels achieving a high strength of the order of 140–160 kgf/mm$^2$. This steel, however, is low hardenability due to suppression of Mn content to less than 0.40%, leaving problems regarding stability of the high strength and occurrence of increased surface defects attributable to insufficient deoxidation. accompanied by insufficient deformability in cold forging. The steel of the above-mentioned patent application has a Ti content greater than 0.05% for the purpose of improving the ductility through making austenitic crystal grains finer. The increased Ti content however is reflected by increasing of the precipitation of Ti oxides and nitrides which bring the improvement in the delayed fracture resistance. Japanese Laid-Open Patent Application 58-117858 discloses a steel which attains a high strength of the order of 130 kgf/mm$^2$ through restriction of P and S contents, while attempting to improve the deoxidization by alloying Si of 0.1–0.8%. This, however, impairs the cold forgeability, and induces the tendency toward production of intergranular oxides in the spheroidizing annealing to impede an improvement in the delayed fracture resistance.

SUMMARY OF THE INVENTION

In view of the foregoing suitations, the present invention has as its object the provision of high strength steels used for bolts which is improved in the delayed fracture resistance without entailing increases the flow stress especially in cold forging.

In accordance with the present invention, there is provided high strength steels used for bolts containing as alloy elements:

$0.30\% \leqq C \leqq 0.50\%$, $Si < 0.10\%$, $0.50\% \leqq Mn \leqq 0.70\%$, $P \leqq 0.01\%$, $S \leqq 0.01\%$, $0.30\% \leqq Cr \leqq 1.05\%$, $0.50\% \leqq Mo \leqq 1.05\%$ $0.01 \leqq Al \leqq 0.05\%$, $0.0020 \leqq Ti < 0.050\%$, and $0.002\% \leqq N \leqq 0.010\%$, the elements Si, Mn, P, S, Mo, Al, Ti and N satisfying the relation as follows $0.05 \leqq Mo - 45P - 11S \leqq 0.85\%$ $7.5Si + 1.7Mn \leqq 1.85\%$, and $0.020\% \leqq 10Ti + Al - 6N \leqq 0.50\%$; and the balance of Fe and inevitable impurities.

The high strength steels used for bolts according to the present invention may optionally contain at least one of Ni and V in the ranges of $0.2\% \leqq Ni \leqq 1.5\%$ and $0.05\% \leqq V \leqq 0.15\%$, According to another aspect of the present invention, there is provided a high strength bolt formed of a steel containing as alloy elements:

$0.30\% \leqq C \leqq 0.50\%$, $Si < 0.10\%$, $0.50\% \leqq Mn \leqq 0.70\%$, $P \leqq 0.01\%$, $S \leqq 0.01\%$, $0.30\% \leqq Cr \leqq 1.05\%$, $0.50\% \leqq Mo \leqq 1.05\%$, $0.01\% \leqq Al \leqq 0.05\%$, $0.0020\% \leqq Ti < 0.050\%$, and $0.002\% \leqq N \leqq 0.010\%$, said elements Si, Mn, P, S, Mo, Al, Ti and N satisfying the relation as follows $0.05\% \leqq Mo - 45P - 11S \leqq 0.85\%$, $7.5Si + 1.7Mn \leqq 1.85\%$ and $0.020\% \leqq 10Ti + Al - 6N \leqq 0.50\%$; and the balance of Fe and inevitable impurities.

The above and other objects, features and advantages of the invention will become apparent from the following description and the appended claims.

PARTICULAR DESCRIPTION OF THE INVENTION

The gist of the present invention resides in an exquisite definition of the range of chemical composition for the high strength steels used for bolts. Therefore, the reasons of addition and of restrictions of additive ranges of the respective alloy elements are explained element by element in the following description.

$$0.30\% \leqq C \leqq 0.50\% \quad (1)$$

Generally, the delayed fracture resistance is apt to be influenced by the tempering temperature, with a trend of dropping to the lowest level when tempered at a temperature of about 350° C. Accordingly, in case of the high strength steels used for bolts with satisfactory the delayed fracture resistance as aimed by the present invention, it is necessary to impart the intended high strength at a tempering temperature higher than 450° C. more specifically, to impart a tensile strength of the order of or higher than 120–130 kgf/mm$^2$ at a tempering temperature higher than 450° C. In order to achieve this, C content has to be greater than 0.30%. On the other hand, it is known from studies that an improvement in the delayed fracture resistance can be achieved through an improvement in toughness. The upper limit of C content is fixed at 0.50% from a viewpoint of preventing deteriorations in the delayed fracture resistance as would result from degradations in toughness.

$$Si < 0.10\% \quad (2)$$

Si is expected to act as a deoxidizer. but the addition of it considered to have a tendency of lowering the cold forgeability, accelerate production of intergranular oxides in spheroidizing annealing, and inpair the intergranular strength. Therefore the delayed fracture resistance is decreased. From this viewpoint, Si content should be smaller than 0.10%.

$$0.50\% \leqq Mn \leqq 0.70\% \quad (3)$$

Mn is an element which improves the hardenability, and makes it easier to attain a high strength. Besides, Mn acts as a deoxidizing element, retaining the deformability in cold forging. However, an excessive additive amount of Mn encourages the tendency of impairing the toughness through normal segregation of Mn, inviting degradations in cold forgeability, and at the same time lowering the intergranular strength by accelerating the production of intergranular oxides similarly to Si content. In consideration of these, the upper limit of Mn is fixed at 0.70%.

$$P \leqq 0.010\% \quad (4)$$

A close study of a crack-initiating point in delayed fracture revealed that the fracture made is the intergranular fracture. It is guessed therefrom that the element P, which is an intergranular segregation element, has the greatest influence on deterioration in the delayed fracture resistance. Therefore, the content of P should be controlled smaller than 0.010% to achieve improvement in the delayed fracture resistance.

$$S \leqq 0.010\% \quad (5)$$

This element forms MnS in the steel, which becomes a point of stress concentration on loading of stress. Therefore, it is necessary to reduce S content less than 0.010% for improvement of the delayed fracture resistance.

$$0.30\% \leqq Cr \leqq 1.05\% \quad (6)$$

The element Cr is useful for acquiring a high strength through increasing of the hardenability, and has a merit that it has no possibilities of impairing the cold forgeability, especially, the deformability to any material degree. Cr should be alloyed in an amount larger than 0.3% to secure the above-mentioned effect. However, an excessive Cr content tends to stabilize carbides, resulting in an insufficient degree of spheroidization, giving negative effects on the cold forgeability. Therefore, the upper limit of Cr content is fixed at 1.05%.

$$0.50\% \leqq Mo \leqq 1.05\% \quad (7)$$

The element Mo is effective for improving the delayed fracture resistance and recommended to be alloyed greater than 0.50%. As the additive amount of Mo is increased, the anti-temperability is improved, so that it becomes possible to increase the toughness of the steel without decreasing its tensile strength, and as a result to improve the delayed fracture resistance. The upper limit of Mo content is fixed at 1.05% because the hardenability becomes saturated.

$$0.01\% \leqq Al \leqq 0.05\% \quad (8)$$

Al contributes to increase the delayed fracture resistance by combining with N in the form of AlN and making the austenitic crystal grains finer. For these purposes, it should be added more than 0.01%. However, an Al content in excess of 0.05% will increase the oxide-base inclusions which impair the delayed fracture resistance. Therefore, the upper limit of Al content is fixed at 0.05%.

$$0.0020\% \leqq Ti < 0.050\% \quad (9)$$

It is known that N is harmful to the delayed fracture resistance. In the present invention, it is a requisite to combine with N in the form of AlN as stated hereinbefore. In order to combine with N completely, Ti should be controlled greater than 0.0020%. The titanium nitrides and carbides contributes to make the austenitic crystal grains finer, thereby positively increasing the delayed fracture resistance. However, Ti content should be smaller than 0.050%, since a Ti excess of 0.050% will decrease the formabilitation, which would especially cause to surface defects in hot rolling.

$$0.002\% \leqq N \leqq 0.010\% \quad (10)$$

As mentioned hereinbefore, N is a harmful element in the delayed fracture resistance and, if it contained in excess of 0.010%, the N content which cannot be combined with Al and Ti does decrease the delayed fracture resistance by increasing the amount of free N. However, if the amount of N content is less than 0.010%, it makes the austenitic crystal grains finer by producing AlN and TiN, giving favorable effects on improvement of the delayed fracture resistance. In order to produce these favorable effects, the content of N should be greater than 0.002%.

$$0.2\% \leqq Ni \leqq 1.5\% \quad (11)$$

Ni is an optionally added element, and, when it is added more than 0.2%, contributes to improve the toughness and therefore, increase the delayed fracture resistance. However, if it is added in excess of 1.5%, it will act to increase the volume of the residual austenite which impairs the delayed fracture resistance.

$$0.05\% \leqq V \leqq 0.15\% \quad (12)$$

V is also an optionally added element, and, when it is added more than 0.05%, has an effect of improving the anti-temperability. However, if it is added in excess of 0.15% with a view to improve the hardenability, it becomes necessary to set the quecing temperature at a level 50° C. higher than the ordinary quenching temperature in bolt manufacturing processes. And the content of V in excess of 0.15% causes to increase the flow stress in cold forging. Therefore, the content of V should be smaller than 0.15%.

$$0.05 \leqq Mo - 45P - 11S \leqq 0.85\% \quad (13)$$

This relation is established on the basis of results of numerous experiments. Improvement in the delayed fracture resistance becomes insufficient when the relation on the left side is not complied with. On the other hand, when the relation on the right side is not satisfied, it is likely that molybdenum carbides are formed and the effect of improving the hardenability of Mo becomes saturated. As the result, the delayed fracture resistance will deteriorate. Besides, the forming of the parts becomes difficult due to degradation in cold forgeability.

$$7.5Si + 1.7Mn \leqq 1.85\% \quad (14)$$

This relation is established also on the basis of results of numerous experiments. In case this relation is not complied with, the flow stress in cold forging becomes higher to such a degree as to shorten the tool life. In consideration of the trend that the cold forgeability is improved as the value of the relation becomes smaller, it is regarded that there is no need for setting a lower limit.

$$0.04\% \leqq 10Ti + Al - 6N \leqq 0.50\% \quad (15)$$

This relation is also established on the basis of results of numerous experiments. With regard to defects resulting from imcompliance with this condition, when the relation on the right side is not satisfied, nitrides and oxides of Ti and Al are produced excessively, decreasing the fatigue properties. In the present invention, the respective alloy elements are added for the reasons stated above. The effects of the present invention are more particularly shown by the following examples of the invention which satisfy the above-discussed conditions and comparative examples which fall outside the range of the chemical composition according to the invention.

EXAMPLES

Tested steels were consisted (round bar of 25 mm in diameter) of the chemical compositions shown in Table 1. Each specimen was used a upsettability test and an delayed fracture in distilled water test to examine the cold forgeability and delayed fracture resistance, respectively. The results are shown also in Table 1. As seen therefrom, the specimens satisfying the conditions of the chemical composition according to the present invention exhibited high delayed fracture resistance without increasing the flow stress.

TABLE 1

| Specimen No. | Chemical Composition (wt %) | | | | | | | | | | | |
|---|---|---|---|---|---|---|---|---|---|---|---|---|
| | C | Si | Mn | P | S | Ni | Cr | Mo | V | Ti | Al | N |
| | | | | | Examples of Invention | | | | | | | |
| 1 | 0.40 | 0.05 | 0.52 | 0.005 | 0.005 | 0.30 | 1.00 | 0.60 | — | 0.0480 | 0.030 | 0.0040 |
| 2 | 0.40 | 0.05 | 0.51 | 0.006 | 0.004 | 0.55 | 1.01 | 0.96 | 0.07 | 0.0060 | 0.032 | 0.0045 |
| 3 | 0.32 | 0.07 | 0.65 | 0.004 | 0.006 | — | 0.54 | 0.72 | — | 0.0100 | 0.035 | 0.0051 |
| 4 | 0.45 | 0.06 | 0.70 | 0.007 | 0.005 | — | 1.02 | 0.56 | — | 0.0300 | 0.033 | 0.0047 |
| 5 | 0.40 | 0.02 | 0.55 | 0.005 | 0.005 | 0.80 | 0.98 | 0.85 | 0.09 | 0.0250 | 0.025 | 0.0050 |
| 6 | 0.33 | 0.07 | 0.64 | 0.005 | 0.005 | — | 0.57 | 0.75 | 0.13 | 0.0120 | 0.031 | 0.0046 |
| 7 | 0.41 | 0.05 | 0.52 | 0.005 | 0.004 | 1.43 | — | 0.65 | — | 0.0450 | 0.033 | 0.0062 |
| 8 | 0.42 | 0.06 | 0.53 | 0.007 | 0.004 | 0.54 | 1.00 | 0.97 | 0.07 | 0.0490 | 0.031 | 0.0059 |
| 9 | 0.40 | 0.04 | 0.52 | 0.003 | 0.004 | 0.90 | 0.95 | 1.01 | 0.12 | 0.007 | 0.015 | 0.0080 |
| | | | | | Comparative Examples | | | | | | | |
| 1 | 0.45 | 0.16 | 0.25 | 0.007 | 0.005 | — | 1.00 | 0.54 | — | 0.0020 | 0.031 | 0.0045 |
| 2 | 0.44 | 0.06 | 0.32 | 0.005 | 0.008 | — | 0.80 | 0.61 | 0.09 | 0.0700 | 0.025 | 0.0051 |
| 3 | 0.40 | 0.25 | 0.90 | 0.006 | 0.004 | — | 1.03 | 0.17 | — | 0.0025 | 0.035 | 0.0045 |
| 4 | 0.45 | 0.16 | 0.66 | 0.011 | 0.012 | 0.56 | 0.99 | 0.98 | 0.12 | 0.0023 | 0.025 | 0.0035 |
| 5 | 0.43 | 0.34 | 0.61 | 0.015 | 0.011 | — | 0.91 | 0.51 | 0.32 | 0.0022 | 0.035 | 0.0042 |
| 6 | 0.43 | 0.36 | 0.75 | 0.022 | 0.014 | 1.83 | 0.84 | 0.28 | — | 0.0022 | 0.024 | 0.0050 |
| 7 | 0.43 | 0.24 | 0.82 | 0.025 | 0.015 | — | 1.15 | 0.26 | — | 0.0020 | 0.031 | 0.0048 |
| 8 | 0.25 | 0.09 | 0.63 | 0.004 | 0.007 | — | 1.00 | 0.75 | — | 0.010 | 0.035 | 0.0070 |
| 9 | 0.52 | 0.08 | 0.70 | 0.008 | 0.008 | — | 1.01 | 0.99 | 0.10 | 0.003 | 0.033 | 0.0070 |
| 10 | 0.40 | 0.27 | 0.65 | 0.008 | 0.006 | 0.56 | 1.03 | 0.95 | 0.10 | 0.010 | 0.019 | 0.0065 |
| 11 | 0.45 | 0.07 | 0.95 | 0.005 | 0.005 | — | 0.95 | 0.98 | — | 0.015 | 0.028 | 0.0057 |
| 12 | 0.45 | 0.06 | 0.68 | 0.006 | 0.007 | — | 0.25 | 0.80 | — | 0.012 | 0.025 | 0.0047 |
| 13 | 0.43 | 0.09 | 0.65 | 0.007 | 0.009 | — | 0.95 | 0.40 | — | 0.035 | 0.030 | 0.0045 |
| 14 | 0.45 | 0.06 | 0.54 | 0.009 | 0.005 | — | 0.80 | 1.40 | — | 0.030 | 0.035 | 0.0050 |

| Specimen No. | Relation*1 1 | Relation*2 2 | Relation*3 3 | Properties TS*4 (kgf/mm²) | σ100D*5 (kgf/mm²) | σ*6 (kgf/mm²) | ϕ*7 (%) |
|---|---|---|---|---|---|---|---|
| | | | Examples of Invention | | | | |
| 1 | 0.32 | 1.22 | 0.486 | 150 | 187 | 85 | 74 |
| 2 | 0.65 | 1.24 | 0.065 | 158 | 204 | 93 | 74 |
| 3 | 0.47 | 1.63 | 0.104 | 145 | 185 | 80 | 76 |
| 4 | 0.19 | 1.64 | 0.305 | 152 | 188 | 89 | 72 |

TABLE 1-continued

| | | | | | | | |
|---|---|---|---|---|---|---|---|
| 5 | 0.57 | 1.08 | 0.245 | 156 | 205 | 90 | 74 |
| 6 | 0.47 | 1.61 | 0.123 | 150 | 190 | 83 | 75 |
| 7 | 0.38 | 1.26 | 0.446 | 157 | 196 | 78 | 72 |
| 8 | 0.61 | 1.37 | 0.486 | 157 | 206 | 95 | 73 |
| 9 | 0.83 | 1.18 | 0.037 | 160 | 207 | 94 | 74 |
| | | | Comparative Examples | | | | |
| 1 | 0.17 | 1.62 | 0.024 | 147 | 176 | 89 | 70 |
| 2 | 0.29 | 0.99 | 0.694 | 145 | 178 | 77 | 70 |
| 3 | −0.14 | 3.40 | 0.033 | 140 | 130 | 87 | 69 |
| 4 | 0.35 | 2.32 | 0.027 | 157 | 175 | 101 | 69 |
| 5 | −0.28 | 3.58 | 0.032 | 152 | 155 | 95 | 68 |
| 6 | −0.86 | 3.97 | 0.016 | 140 | 145 | 92 | 68 |
| 7 | −1.03 | 3.19 | 0.022 | 140 | 125 | 91 | 69 |
| 8 | 0.49 | 1.75 | 0.093 | 140 | 100 | 83 | 80 |
| 9 | 0.54 | 1.79 | 0.021 | 160 | 173 | 103 | 67 |
| 10 | 0.52 | 3.13 | 0.08 | 155 | 177 | 102 | 70 |
| 11 | 0.70 | 2.14 | 0.144 | 157 | 163 | 100 | 69 |
| 12 | 0.45 | 1.61 | 0.117 | 150 | 180 | 88 | 69 |
| 13 | −0.01 | 1.78 | 0.353 | 155 | 167 | 85 | 71 |
| 14 | 0.94 | 1.37 | 0.305 | 156 | 185 | 100 | 68 |

*[1]Relation 1: 0.05 Mo − 45 P − 11 S 0.85
*[2]Relation 2: 7.5 Si + 1.7 Mn 1.85
*[3]Relation 3: 0.02 10 Ti + Al − 6 N 0.50
*[4]TS (kgf/mm$^2$): Tensile strength (kgf/mm$^2$)
*[5]$\sigma$100D (kgf/mm$^2$): 100 Hr delayed fracture resistance
*[6]$\sigma$ (kgf/mm$^2$): Flow stress
*[7]$\phi$ (%): Deformability

What is claimed is:

1. High strength bolts formed of steels containing as alloy elements:

$0.30\% \leqq C \leqq 0.50\%$, $Si < 0.10\%$, $0.50\% \leqq Mn \leqq 0.70\%$, $P \leqq 0.01\%$, $S \leqq 0.01\%$, $0.30\% \leqq Cr \leqq 1.05\%$, $0.50\% \leqq Mo \leqq 1.05\%$, $0.01\% \leqq Al \leqq 0.05\%$, $0.0020\% \leqq Ti < 0.050\%$, and $0.002\% \leqq N \leqq 0.010\%$, said elements Si, Mn, P, S, Mo, Al, Ti and N satisfying the relation as follows $0.05\% \leqq Mo - 45P - 11S \leqq 0.85\%$, $7.5Si + 1.7Mn \leqq 1.85\%$ and $0.020\% \leqq 10Ti + Al - 6N \leqq 0.50\%$;

and the balance of Fe and inevitable impurities.

2. High strength bolts as defined in claim 1, wherein said steels optionally contains at least one of Ni and V in the ranges of $0.2\% \leqq Ni \leqq 1.5\%$ and $0.05\% \leqq V \leqq 0.15$.

* * * * *